US011525286B2

(12) United States Patent
Liu

(10) Patent No.: US 11,525,286 B2
(45) Date of Patent: Dec. 13, 2022

(54) MOTOR VEHICLE LATCH WITH COVER

(71) Applicant: Kiekert AG, Heiligenhaus (DE)

(72) Inventor: Yuhui Liu, Wodehuayuan (CN)

(73) Assignee: Kiekert AG, Heiligenhaus (DE)

( * ) Notice: Subject to any disclaimer, the term of this patent is extended or adjusted under 35 U.S.C. 154(b) by 799 days.

(21) Appl. No.: 16/088,128

(22) PCT Filed: Mar. 20, 2017

(86) PCT No.: PCT/IB2017/000269
§ 371 (c)(1),
(2) Date: Sep. 25, 2018

(87) PCT Pub. No.: WO2017/163118
PCT Pub. Date: Sep. 28, 2017

(65) Prior Publication Data

US 2020/0300004 A1 Sep. 24, 2020

(30) Foreign Application Priority Data

Mar. 25, 2016 (CN) ..... 201610178223.6

(51) Int. Cl.
*E05B 77/34* (2014.01)
*E05B 79/02* (2014.01)
*E05B 85/02* (2014.01)

(52) U.S. Cl.
CPC ..... *E05B 77/34* (2013.01); *E05B 79/02* (2013.01); *E05B 85/02* (2013.01); *E05Y 2900/50* (2013.01)

(58) Field of Classification Search
CPC ..... E05B 77/34; E05B 79/02; E05B 85/02; E05Y 2900/50
See application file for complete search history.

(56) References Cited

U.S. PATENT DOCUMENTS 4,679,836 A * 7/1987 Pupillo ..... E05B 77/38 292/216
6,050,117 A * 4/2000 Weyerstall ..... E05B 77/26 292/201

(Continued)

FOREIGN PATENT DOCUMENTS

DE 4444048 11/1999
DE 10144166 4/2003

(Continued)

OTHER PUBLICATIONS

International Search Report and Written Opinion for corresponding Patent Application No. PCT/IB2017/000269 dated Jun. 2, 2017.

*Primary Examiner* — Kristina R Fulton
*Assistant Examiner* — James E Ignaczewski
(74) *Attorney, Agent, or Firm* — Renner, Otto, Boisselle & Sklar, LLP

(57) ABSTRACT

A motor vehicle latch with a locking mechanism comprising a catch and a pawl for catching of the catch and a housing with an inlet slot for a latch holder which can go through the inlet slot into the housing in the event of closure of a door or flap and can be held there by the locking mechanism in such a way that the door or flap cannot open in an unscheduled manner, whereby the housing demonstrates a cover on a side of the housing with the inlet slot which is attached to the housing with the aid of a positive connection produced by suspension. An especially reliable fixing of the cover can thus be facilitated. Furthermore, the invention relates to a mounting procedure for the cover to the housing.

17 Claims, 3 Drawing Sheets

(56) References Cited

U.S. PATENT DOCUMENTS

Figure 1:
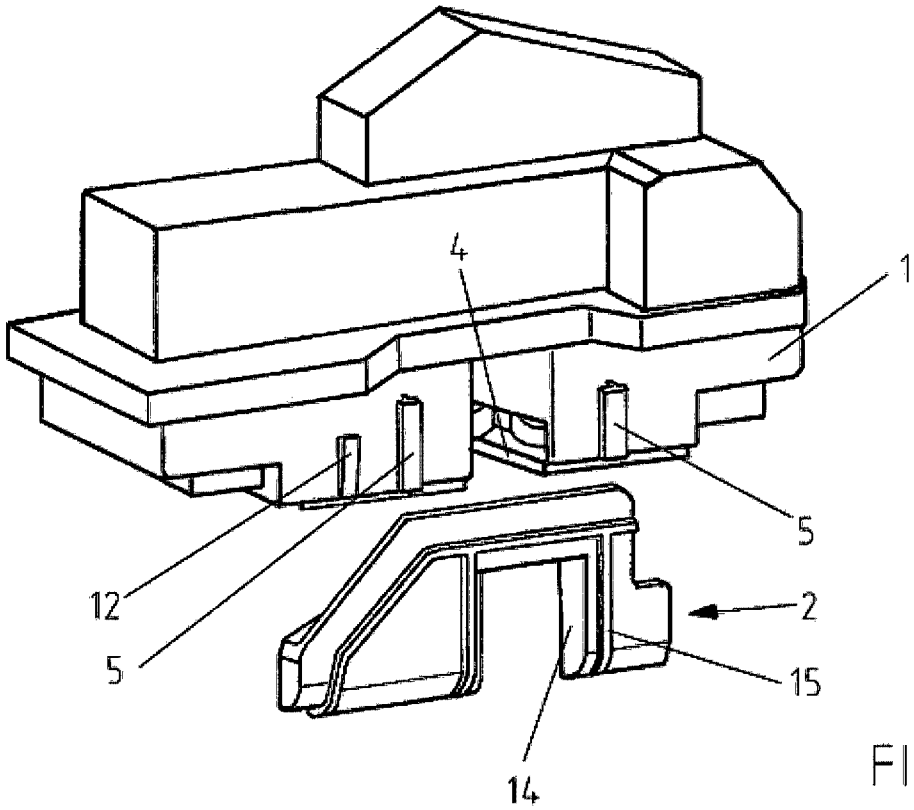

| | | | | |
|---|---|---|---|---|
| 2013/0047374 | A1* | 2/2013 | Muramatsu | E05B 85/045<br>16/82 |
| 2014/0333076 | A1 | 11/2014 | Graute | |

FOREIGN PATENT DOCUMENTS

| | | | | |
|---|---|---|---|---|
| DE | 102007025359 | | 12/2008 | |
| DE | 102008035390 | | 2/2010 | |
| DE | 102009040014 | | 3/2011 | |
| EP | 0103904 | | 3/1984 | |
| FR | 2923249 | | 5/2009 | |
| FR | 2923249 | A1 * | 5/2009 | E05B 79/12 |
| JP | 2003214008 | | 7/2003 | |
| JP | 2003214008 | A * | 7/2003 | |

* cited by examiner

MOTOR VEHICLE LATCH WITH COVER

The invention relates to a motor vehicle latch with a cover in accordance with the superordinate term of the main claim and an installation procedure.

A motor vehicle latch, in particular a motor vehicle door latch, generally includes at least a latch plate or an L-shaped latch case with the latch plate and a locking mechanism located thereon comprising a catch and a pawl for latching of the catch. Furthermore, the motor vehicle latch demonstrates a housing. The latch plate or the latch case are generally at least partly arranged inside a housing and/or themselves form a part of the housing. The housing of the motor vehicle latch demonstrates an inlet slot which acts as an entrance opening for accommodating a generally U-shaped locking bolt, in order that when the door or flap is closed the locking bolt can go through the inlet slot inside the housing in order to be accommodated by the catch there and latched via the catch with the aid of the pawl. The door or flap can then no longer be opened.

In some vehicles, motor vehicle latches are used which provide for an additional cover on the housing on the side of the inlet slot, i.e. in the direction of movement of the locking bolt when the door or flap is opened. Such a cover is then generally arranged between the side of the housing with the inlet slot and the sheet metal of the door or flap, in particular the internal sheet metal of the door and fundamentally in such a way that the cover is not only adjacent to the housing, but also to the sheet metal. The cover is usually attached to the housing with the aid of one or several screws. However, with this method of attachment slight changes of the orientation and/or position of the cover sometimes occur during operation. A deformation of the cover is also possible.

With regard to the state of the art, reference is made to the publications US 2014/0333076 A1, DE 10 2008 035 390 A1, DE 10 2007 025 359 A1, DE 101 44 166 A1, DE 44 44 048 C2, FR 29 23 249 A1 and DE 10 2009 040 014 A1.

The aforementioned features known from the state of the art can be combined individually or in any combination with one of the objects in accordance with the invention described hereafter.

It is the task of the invention to provide a further developed motor vehicle latch with a cover in addition to the installation procedure.

A motor vehicle latch with a cover with the characteristics of the main claim and an installation procedure in accordance with the secondary claim solve this task. Advantageous execution forms result from the sub-claims.

A motor vehicle latch with a locking mechanism comprising a catch and a pawl for a latching of the catch and a housing with an inlet slot for a latch holder, which when the door or flap is closed can go through the inlet slot into the housing where it can be held by the locking mechanism in such a way that the door or flap cannot open in an unscheduled manner, whereby the housing on one side of the housing demonstrates a cover with the inlet slot which is arranged on the housing with the aid of a positive connection produced by suspension solves the task.

Cover means a flat supporting element which is generally flat and parallel to the surface to which the cover is attached i.e. in the present case the housing side with the inlet slot. In principle, the attachment side of the cover which is attached to the housing is adapted to the surface of the area covered by the cover of the housing side, in particular in such a way that a flat adjacency of the supporting surfaces are striven towards or attained as interface surfaces between the cover and the housing. Such supporting surfaces can also be formed by struts.

In principle, in the mounted state the cover of the motor vehicle latch is arranged between the housing and the sheet metal. In the event of bordering or adjacency of the cover with sheet metal, in particular the internal sheet metal of the door, the outside of the cover which is deflected to the sheet metal in the door or flap in the mounted state of the motor vehicle latch, is also adapted to the contour of the sheet metal or at least fundamentally to the course of the sheet metal for a flat or as flat as possible adjacency of the contact surfaces as interface surfaces. The entire external surface of the cover is preferably and fundamentally adapted to the sheet metal.

Suspension means translational movement parallel to the housing side or its surface, in particular in such a way that the cover on the housing glides to an envisaged mounting position, i.e. on the surface of the housing side to which the cover is attached. The cover therefore fundamentally glides with the attachment side on the housing side for the purpose of mounting. Suspension does not in fact mean the mere latching of a clip connection in which not simultaneously parallel, flat extended surfaces are glided onto one another, whereby a surface in particular also from a flatly extended rib structure can be formed with a majority of supporting surfaces aligning flush with the level of the surface.

The suspension is preferably linear, i.e. in a straight line, i.e. without curves. Especially simple mounting can thus be facilitated.

A positive connection produced by suspension enables an especially reliable retention of the orientation and position of the cover. Differently than for example for a screwing, in which only selectively a ring-shaped area of the cover is pressed onto the housing, a positive connection by means of suspension can ensure that an especially large part of the cover or the entire cover is pressed uniformly, flatly onto the housing and thus both the orientation and the location in operation are especially reliably retained. An undesired deformity of the cover which is generally made of plastic as a result of pressing can also be prevented with special effectiveness. An especially great dimensional stability of the cover is thus possible after installation and in operation. A closed adjacency or suspension of the cover on the housing and/or the sheet metal can thus also be attained with special reliability in operation, i.e. an uninterrupted contact line or contact surface or an extensive and/or close adjacency, in particular of the contact surfaces.

Thus, the cover enables the inside of the chassis of the door or flap to be protected from wetness and moisture which would otherwise penetrate through the inlet slot in the sheet metal and externally on the housing on the cover between the housing and the sheet metal into the area within the door sheet metal or flap sheet metal.

A further aspect of the invention relates to an installation procedure for a motor vehicle latch, in particular the motor vehicle latch described above in accordance with the invention, with a locking mechanism comprising a catch and a pawl for a latching of the catch and a housing with an inlet slot for a latch holder, which when the door or flap is closed can go through the inlet slot into the housing where it can be held by the locking mechanism in such a way that the door or flap cannot open in an unscheduled manner, whereby a cover on one side of the housing is suspended with the inlet slot to produce a positive connection between the cover and the housing.

Especially simple and rapid mounting of the cover onto the housing and thus the motor vehicle latch as a whole can thus be facilitated.

Execution examples of the invention are explained in further detail on the basis of figures hereinafter. Features of the execution examples can be individually or severally combined with the stressed object.

Figure 5:
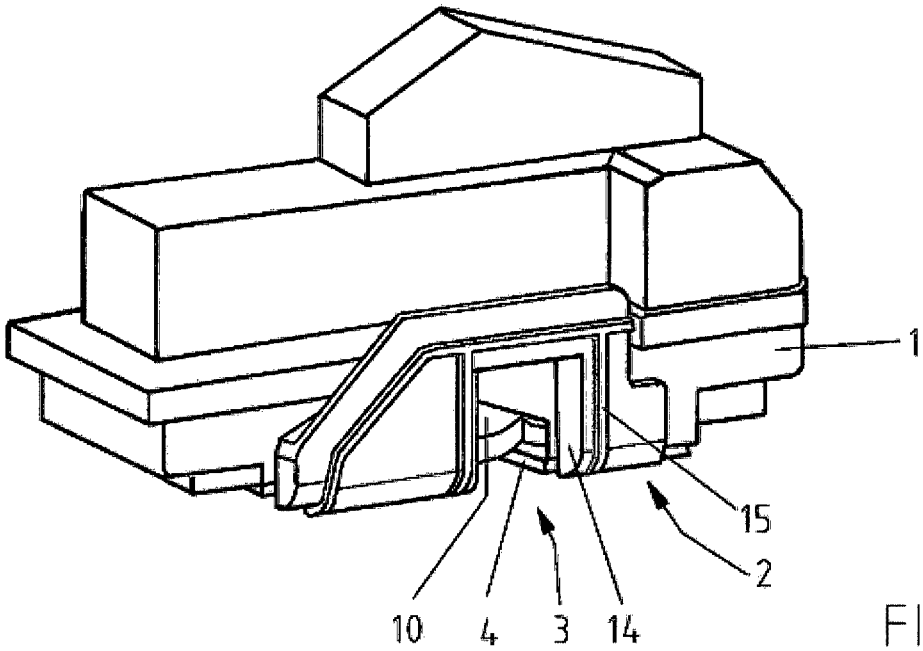
Figure 6:
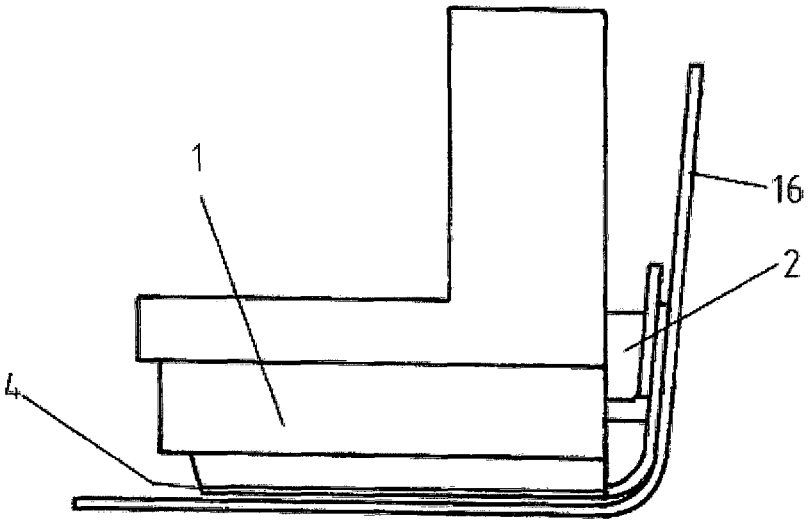

The following are shown:

FIG. 1: Diagrammatic representation of the motor vehicle latch and the cover (seen from the inside sheet metal of the door) before mounting FIG. 2: Detailed view of a sliding rail with an indentation on the side of the housing with the inlet slot FIG. 3: Diagrammatic representation of the attachment side of the cover FIG. 4: Detailed view of a groove adapted to the sliding rail with Indentation on the attachment side of the cover FIG. 5: Diagrammatic representation of the motor vehicle latch and the cover (seen from the inside sheet metal of the door) after mounting FIG. 6: Diagrammatic representation of the motor vehicle latch and the cover and the inside sheet metal of the door after mounting in the lateral view FIG. 6 shows a motor vehicle latch in an operational state and installed in a door or flap. The catch 10, which is pivotably mounted on the latch plate 4, usually has a load arm and a catching arm which together form a fork-shaped mounting of the catch 10, in which the locking bolt (not illustrated) of a motor vehicle door or flap, for example a hood or a trunk flap goes during passage of the inlet slot 3 of housing 1 if the door or flap is closed. The locking bolt then rotates the catch 10 from an open position to a closed position. If the catch 10 has reached the closed position, it is latched via the pawl in this position.

As shown by FIG. 1, the housing 1 has a housing side with the inlet slot 3 which is open in a U-shape towards the latch plate 4. On this side of the housing (hereinafter 'housing side' always means in particular this housing side with the inlet slot 3) the cover 2 is suspended in FIGS. 5 and 6, whereby a positive connection was produced between the housing 1 and the cover 2.

In one execution form one or exactly two sliding rails 5 with an indentation in particular on the housing side and/or one or exactly two grooves 6 with indentation are provided for suspension on the sliding rails 5 with an indentation in particular on an attachment side of the cover 2 (see FIGS. 1 to 4) to produce the positive connection.

Indentation means that in the cross-section of the sliding rails 5 or groove 5 an indenting contour is provided for which is capable of preventing loosening orthogonally to the connecting surface.

By means of a sliding rail 5 with an indentation or a groove 6 with indentation an especially reliable maintenance of the orientation and location of the cover 2 can be attained. An especially large surface for uniform application of the pressure onto the cover 2 ensures an especially large-area adjacency of the interface surfaces to the neighbouring components, i.e. housing 1 and/or sheet metal 16 for especially effective sealing. With exactly two sliding rails 5 this effect can be attained with special reliability and effectiveness.

A sliding rail 5 with an indentation and a groove 6 with an indentation enable especially reliable fixing of the cover 2 and thus seal to be attained.

In particular, the sliding rails 5 and the groove 6 are adapted to one another in such a way that suspension with manual force can be facilitated and/or in the mounted state a firm hold can be retained, i.e. without the possibility of movement or rattling.

As shown in the figures, in the present case two sliding rails 5 are preferably provided for with a different length on the housing 1. One or exactly two sliding rails 5 are furthermore orientated in principle flush on the edge of the housing side with the latch plate 4.

The end of the sliding rail 5 orientated towards the edge demonstrates a phase of preferably 45° at the especially entire end contour for the better threading of the groove. The groove 6 can also demonstrate a phase of preferably 45° at the especially entire end contour for the same purpose at an open end which is intended for suspension on the sliding rail 5.

In particular, all sliding rails 5 are orientated parallel to one another and in particular demonstrate an identical cross-sectional profile.

In one execution form, the sliding rails 5 and/or the groove 6 are orientated orthogonally to a latch plate 4 of the motor vehicle latch.

Orthogonally to the latch plate 4 means vertically on the flat expanse of the latch plate 4, which generally runs orthogonally to the rotational axis of the catch 10.

Especially simple suspension can thus be facilitated. Because in this direction no contours of the motor vehicle latch are generally standing in the way which could block suspension.

In particular, all sliding rails 5 and/or grooves 6 are orientated parallel to one another, whereby in principle this orientation is fundamentally parallel to the inlet slot 3, i.e. is orientated in its extension direction starting from an edge with the latch plate 4.

In one execution form the sliding rail 5 is a full body with a closed contour above a surface on which the sliding rail 5 is arranged.

In fact, full body does not mean a scheduled cavity. The sliding rail 5 is therefore single-component in particular or in other words a single unit, in particular injection moulding preferably injection-moulded together with the housing 1, i.e. a single component with the housing 1.

Closed contour above a surface on which the sliding rail 5 is arranged means that the sliding rail 5 does not, for example, demonstrate a vertical slot in the cross section which extends to the surface and divides the sliding rail 5 in two halves. In this case, two separate sliding rails would be present.

One sliding rail 5 executed as a full body with a closed contour is capable of absorbing especially great force and thus enables an especially stable positive connection.

In one execution form the groove 6 is admitted into an even surface as a recess.

Figure 3:
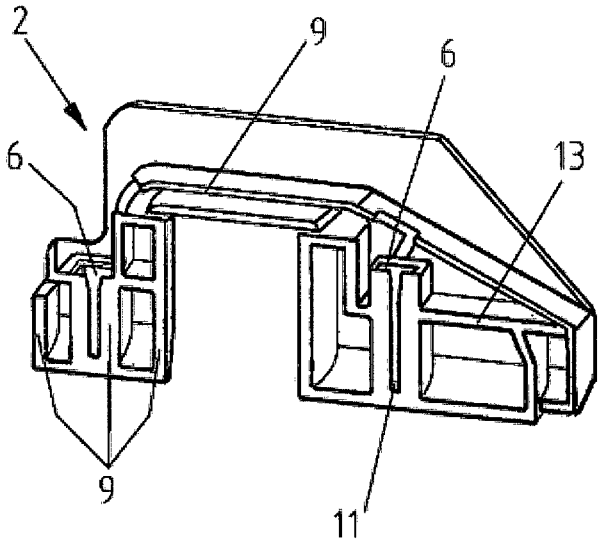

Surface is not limited here to a flatly closed surface, but also encompasses a surface formed of several contact surfaces 9 arranged flush in the level of the surface, as shown in FIG. 3. The edge structures which limit and/or form the groove 6 therefore do not protrude above the surface or the level of the attachment side or the contact surfaces 9 on the level of the attachment side. An especially uniform distribution of the pressure and especially effective sealing can thus be facilitated.

In one execution form the length of the sliding rail 5 and/or the groove 6 is at least 35% of the extent of the inlet slot 3 orthogonally to the latch plate 4, preferably at least 50%, most preferably 65%.

An especially reliable ascertainment of the orientation and position of the cover in operation can thus be guaranteed.

In one execution form the sliding rail 5 and/or the groove 6 demonstrate a T-shape in the cross section. An indentation can thus be produced at especially low manufacturing cost. Furthermore, an especially uniform, flat distribution of the pressure onto the entire cover is possible.

Figure 2:
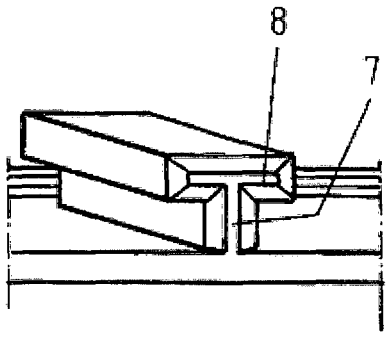
Figure 4:
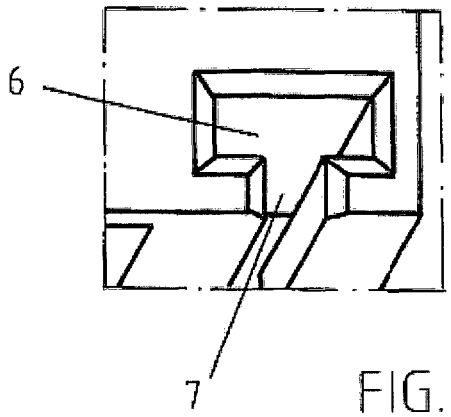

The T-shape basically protrudes on an even surface of the housing side and from this surface. An I-shaped stem 7 of the T-shape is therefore based in particular vertically on the surface, in particular of the housing side. The T shape is therefore not engaged, for example. FIGS. 2 and 4 show the T-shape.

In one execution form the I-shaped stem 7 of the T-shape has the same breadth in the cross section or fundamentally the same breadth as a wing 8 protruding orthogonally to the I-shaped stem 7, in particular two horizontally protruding wings 8.

The breadth of the stem 7 must be measured like the breadth of the inlet slot 3 in the lengthwise direction of the edge from the housing side with the latch plate 4, while the breadth of a wing 8 protruding orthogonally to the stem 7 must be measured transversely.

An especially simple, manual suspension for the purpose of mounting and an especially uniform, flat force transmission can thus be facilitated.

The T-shape of the sliding rail 5 is executed as a full body, i.e. without envisaged cavities in the cross section and/or firmly bonded with the housing 1 or manufactured from one injection-moulded component.

The breadth of the T-shape, i.e. the length of both wings 8 plus the breadth of the stem 7, is at least 10%, preferably, 20%, most preferably 30% and/or maximum 60%, preferably maximum 50%, most preferably maximum 40% of the breadth of the inlet slot 3. The horizontally protruding wings 8 are respectively fundamentally long like the vertical length of the I-shaped stem underneath the lateral wing or maximum 15%, preferably 25%, most preferably 35% or 50% longer in a further execution form.

In one execution form the housing 1 and the cover 2 are created in such a way that only a single step of suspension or a mere suspension of the cover 2 on the housing 1 up to an envisaged mounting position of the cover 2 is sufficient for complete mounting of the cover 2 onto the housing 1. i.e. no other separate connectors or components are necessary or need to be attached to complete mounting.

Especially simple and rapid mounting can thus be facilitated.

In one execution form the envisaged mounting position of the cover 2 is defined in particular as the end position of a conducted suspension through a stop of the cover 2 against the housing 1 and/or a catch connection, whereby such a catch connection is created in such a way that the catch connection only catches upon reaching the envisaged mounting position.

Cover stop 2 against the housing 1 can be a stop end 11 in the groove 6. Such a stop end 11 has the double function of an external wall for sealing. However, the cover stop 2 against the housing 1 can also be a stopping of an edge or a rib of the cover 2 against a protrusion of the housing 1 which protrudes from the level of the housing side. Preferably, no stop is envisaged on a sliding rail 5 in order to prevent overdetermination of the system.

The mounting position or end position demonstrate a mounting clearance in principle. In the event of provision of a catching connection and one or several other stops the mounting clearance must preferably be large enough that the catching connection can engage before the stop or one of the stops blocks further suspension. Reliable catching of the catching connection can thus be ensured.

In addition to the friction force, the catching connection assists with an especially reliable holding of the orientation and position of the cover 2. Due to the mounting clearance the friction forces between the sliding rail 5 and the groove 6 and between the attachment side of the cover 2, i.e. of the supporting surfaces 9, and the housing 1 in particular are sufficient to prevent movement of the cover 2 in principle also within the mounting clearance in operation or to at least effectively counteract this.

By emitting an audible clicking noise the catching connection therefore also acts as a signal for the installer that the mounting position has been attained and the cover 2 does not need to be pushed further onto the housing.

In one execution form, one or exactly one ramp 12 is provided for in particular on the housing side for the catching connection of the cover 2.

A catching connection can thus be provided with especially low manufacturing cost.

The ramp 12 commences as shown in FIG. 1 at the height of the surface of the housing side and/or at the edge of the latch plate 4 with the housing side. The ramp 12 then increases in a linear manner, therefore runs inclined in particular upwards, whereby upwards means orthogonally to the surface of the housing side. The ramp 12 ends at a distance from the surface, i.e. the height of the ramp 12, which corresponds to maximum 50%, preferred maximum 30%, especially preferred maximum 15% of the height or breadth of the stem 7 of the T-shape. The ramp 12 preferably protrudes not more than 1 mm above the surface (height).

Ramp 12 is preferably formed as a full body and/or positively connected with the housing 1 or manufactured as a single component with the housing 1 by injection moulding. Further, the ramp 12 is preferably arranged separately from the sliding rail 5 and/or the groove 6 in particular on the housing side.

In principle, the ramp 12 is parallel to the sliding rail 5 and/or groove 6. The length of the ramp 12 is at least 50% and/or maximum 100% of the length of a sliding rail 5. The breadth of the ramp 12, i.e. the extension in level of the housing side and orthogonally to the length fundamentally corresponds to the breadth of the sliding rail 5 or at least 20% less or more.

The ramp 12 is at least at a distance of once, preferably twice and/or maximum five times, preferably maximum four times the breadth of the sliding rail 5 from the sliding rail 5 transversely to the lengthwise extension of the sliding rail 5 from the sliding rail 5.

FIG. 1 shows the sequence of the arrangement of the ramp 12, sliding rail 5 and inlet slot 3 along the edge of the housing side with the latch plate 4. Initially, the ramp 12 is provided, then a first sliding rail 5, then the inlet slot 3 and finally a second sliding rail 5.

This sequence of the arrangement enables an especially uniform load distribution, great dimensional stability of the cover and space-saving accommodation of the ramp 12.

In one execution form, one rib 13 of the cover 2 is provided for catching with a catch contour, especially of the ramp 12 for the catching connection.

A double function of the rib 13 can thus be attained. On the one hand, the rib 13 slides up the ramp 13 and at the end of the ramp during suspension of the cover 2 enabled by elastic deformability of the cover especially manufactured from plastic as a result of the pre-tensioning by the elastically deformed cover into the opposite direction down to the surface of the housing side and thus catches with the ramp 13. Consequently, the cover 2 can no longer be pushed downwards, i.e. in the opposite direction of the suspension. These ribs 13 are preferably arranged parallel to the edge of the housing side with the latch plate 4.

On the other hand, the rib 13 can be a component of a carrying rib structure with several ribs 13 which in accordance with a further execution form forms the basis for the cover 2 in particular with a flat surface which covers the rib structure. The ribs 13 are then injection-moulded in principle together with the cover 2 in a single component. The ribs 13 are arranged in particular on the attachment side of the cover 2 and demonstrate cavities between one another. A large volume of the cover 2 can thus save materials in particular whilst still retaining stability.

In particular, the cover demonstrates a thickness which corresponds to at least 20%, preferably 30%, of the breadth of the inlet slot 3 and/or maximum 100%, preferably maximum 80%, of the breadth of the inlet slot 3. The thickness of the cover 2 must be measured orthogonally to the attachment side or external side or in the direction of movement of the locking bolt during opening or closure of the door. The breadth of the inlet slot 3 must be measured in the direction of the edge of the housing side and the latch plate 4.

A motor vehicle latch of an identical construction can thus only be used by adjustment of the cover thickness in different vehicles with different door or flap dimensions.

In one execution form, the cover 2 completely surrounds the inlet slot 3 on the housing side, in particular in a u-shape, and/or the housing side is orientated orthogonally to the latch plate 4.

By the cover 2 surrounding the inlet slot 3, sealing can be especially effective.

A housing side orientated orthogonally to the latch plate 4 enables a compact design and effectively counteracts a shifting of the cover 2 in the event of pressure on the cover from the sheet metal 16 opposite the housing side.

The cover 2 stretches flatly in particular only over the housing side or over a part of the housing side. The flat surface of the cover 2 therefore demonstrates a u-shaped recess, which is open to the latch plate 4 in principle. A shell surface 14 which stretches orthogonally to the flat surface of the cover 2 is connected to the edge of the u-shaped recess which is formed by ribs 12 and when closed reach to the surface of the cover 2 in order that in the mounted state of the motor vehicle latch in the door or flap the inlet slot 3 is surrounded in a closed u-shape from the sheet metal 16 to the housing side by the cover 2. Moisture can thus be prevented from penetrating the interior of the chassis of the door or flap.

In one execution form an external side of the cover, i.e. the flat surface of the cover 2 on the opposite side of the attachment side, has a bridge 15 that extends from the flat surface and the bridge is an interface surface for the adjacent sheet metal 16 of a door or flap.

Interface surface means a section of the surface which generally lies adjacent together with other, separate area sections to neighbouring pieces of sheet metal 16 or the housing 1 and thus form the interface.

Due to provision of a bridge 15 the contact pressure between the cover 2 and the sheet metal 16 of the door or flap increases and therefore produces an especially dense contact line or contact area for sealing. In addition, an especially targeted sealing along the bridge contour can be facilitated by the bridge 15. An extensive adjacency and sealing vis-à-vis the sheet metal 16 can thus be facilitated by the cover 2.

In addition, a rubber seal (not illustrated) can be used on the external edge of the cover above the bridge 15 which can be laid around the edge and to the latch plate 4 in order to facilitate especially effective sealing. The bridge 15 demonstrates the height or fundamentally the height of the aforementioned ramp 12. Furthermore, the bridge 15 can have the breadth or fundamentally the breadth of the stem 7 of the T-shape. Preferably the bridge 15 runs parallel to the outlines of the inlet slot 3 in particular with at least a distance of one bridge breadth to the external edge of the cover. The bridge 15 can also demonstrate a junction in order to additionally be formed on the entire external edge or only a part thereof. As shown in FIG. 6, the cover 2 is in the mounted state both on the housing 1 and adjacently on the sheet metal 16 of the door or flap, in particular around the inlet slot 3.

The direction of the suspension is going from the edge of the housing side with the latch plate 4 especially parallel to the housing side in the direction of the housing or in the extension direction of the inlet slot 3 of the housing side. The cover 2 is therefore suspended upwards in FIG. 1.

In the mounted state of the motor vehicle latch the cover 2 can in principle be clamped to a certain extent between the sheet metal 16 and the housing 1.

In particular, the cover 2 is bare or only suspended, i.e. no other mounting step and no other connector is envisaged for the attachment of the cover. Particularly quick and simple mounting of the cover to the housing 1 and thus the motor vehicle latch overall can thus be enabled. The cover is preferably pushed onto the housing side until catching of a catching connection.

The invention claimed is:

1. A motor vehicle latch comprising:

a locking mechanism having a catch and a pawl for catching of the catch;

a housing with an inlet slot for a latch holder which is received in the inlet slot into the housing during a closure of a door or flap, the latch holder configured to be held in the inlet slot by the locking mechanism to prevent the door or flap from opening in an unscheduled manner; and a cover arranged on a side of the housing that defines the inlet slot, the cover being configured to be attached to the housing via a positive connection produced by suspension, wherein the cover stretches flatly over only the side of the housing, wherein the side of the housing includes at least one sliding rail having an indentation and the cover includes at least one groove that has an indentation and is configured for suspension on the at least one sliding rail, wherein the at least one sliding rail and the at least one groove are configured to enable a translational movement of the cover during which the cover glides along the side of the housing, the translational movement of the cover being parallel with the side of the housing; and wherein an external side of the cover opposite from the side of the housing includes a flat surface and a bridge that extends from the flat surface, and the bridge is an interface surface for a neighboring piece of sheet metal.

2. The motor vehicle latch in accordance with claim 1, wherein the sliding rail and/or the groove are orientated orthogonally to a latch plate of the motor vehicle latch.

3. The motor vehicle latch in accordance with claim 1, wherein the at least one sliding rail is a continuous one-piece full body with a closed contour above a surface on which the sliding rail is arranged.

4. The motor vehicle latch in accordance with claim 1, wherein the groove is inserted into an even surface as a recess.

5. The motor vehicle latch in accordance with claim 1, wherein the length of the sliding rail and/or the groove is at least 35% of the extension of the inlet slot orthogonally to the latch plate.

6. The motor vehicle latch in accordance with claim 1, wherein the sliding rail and/or the groove forms a T-shape in the cross-section.

7. The motor vehicle latch in accordance with claim 6, wherein an I-shaped stem of the T-shape in the cross section forms a same breadth or approximately the same breadth as a wing protruding orthogonally to the I-shaped stem.

8. The Motor vehicle latch in accordance with claim 1, wherein the housing and the cover are configured to have a single step of suspension of the cover onto the housing up to an envisaged mounting position.

9. The motor vehicle latch in accordance with claim 1, wherein an envisaged mounting position of the cover is an end position of a conducted suspension and is defined by a stop of the cover against the housing and/or a catching connection that is formed so that the catching connection only catches upon reaching the envisaged mounting position.

10. The motor vehicle latch in accordance with claim 9, wherein one ramp is envisaged on the housing side for the catching connection of the cover.

11. The motor vehicle latch in accordance with claim 9, wherein a rib of the cover is envisaged for catching with a catch contour for the catching connection.

12. The motor vehicle latch in accordance with claim 1, wherein the cover surrounds the inlet slot completely on the housing side and/or the housing side is orientated orthogonally to the latch plate.

13. A mounting procedure for a motor vehicle latch in accordance with claim 1, the mounting procedure comprising suspending a cover on the housing side with the inlet slot for production of a positive connection between the cover and the housing.

14. The motor vehicle latch in accordance with claim 7, wherein the wing includes two horizontally protruding wings.

15. The motor vehicle latch in accordance with claim 11, wherein the catch contour is a ramp.

16. The motor vehicle latch in accordance with claim 12, wherein the cover surrounds the inlet slot in a U-shape.

17. The motor vehicle latch in accordance with claim 3, wherein the continuous one-piece full body defines two slots that are engageable with the cover.

* * * * *